US009569928B2

(12) United States Patent
Kim et al.

(10) Patent No.: US 9,569,928 B2
(45) Date of Patent: Feb. 14, 2017

(54) METHOD FOR PROVIDING REWARD ITEM OF ONLINE GAME AND APPARATUS FOR THE SAME

(71) Applicant: Intellectual Discovery Co., Ltd., Seoul (KR)

(72) Inventors: Woon Yong Kim, Suwon-si (KR); Chul Min Lee, Seongnam-si (KR)

(73) Assignee: INTELLECTUAL DISCOVERY CO., LTD., Seoul (KR)

( * ) Notice: Subject to any disclaimer, the term of this patent is extended or adjusted under 35 U.S.C. 154(b) by 286 days.

(21) Appl. No.: 14/369,572

(22) PCT Filed: Nov. 27, 2012

(86) PCT No.: PCT/KR2012/010093

§ 371 (c)(1),
(2) Date: Jun. 27, 2014

(87) PCT Pub. No.: WO2013/100390

PCT Pub. Date: Jul. 4, 2013

(65) Prior Publication Data

US 2015/0011286 A1 Jan. 8, 2015

(30) Foreign Application Priority Data

Dec. 28, 2011 (KR) ..... 10-2011-0145281

(51) Int. Cl.
*G07F 17/32* (2006.01)

(52) U.S. Cl.
CPC ..... *G07F 17/3244* (2013.01)

(58) Field of Classification Search
USPC ..... 463/16–26
See application file for complete search history.

(56) References Cited

U.S. PATENT DOCUMENTS

2014/0323217 A1* 10/2014 Kim ..... G07F 17/32 463/31
2014/0349766 A1* 11/2014 Kim ..... A63F 13/10 463/42
2014/0357378 A1* 12/2014 Jung ..... G07F 17/323 463/42

FOREIGN PATENT DOCUMENTS

JP 2007175393 A 7/2007
JP 2008100065 A 5/2008
JP 2010104651 A 5/2010
KR 1020070024906 A 3/2007

OTHER PUBLICATIONS

International Search Report issued in Appln. No. PCT/KR2012/010093, dated Mar. 11, 2013.

* cited by examiner

*Primary Examiner* — Ronald Laneau
(74) *Attorney, Agent, or Firm* — Sughrue Mion, PLLC

(57) ABSTRACT

A reward item providing method of an online game includes: generating at least one reward item table corresponding to one mode that can be provided in a game and storing at least one reward item available in the other modes; setting each win probability of at least one reward item of at least one reward item table; drawing a won item among at least one item according to the win probability in the reward item table corresponding to the executed mode if the character of the user wins the match in the one mode; displaying a reward item providing screen providing the won item to the character and including a mode entry button to enter an item display mode as a mode using the won item; and entering the item display mode when receiving a selection input for the mode entry button.

11 Claims, 7 Drawing Sheets

Figure 4

| Character level section division | Level range |
|---|---|
| First level section | 1 ~ 30 |
| Second level section | 31 ~ 80 |
| Third level section | 80 ~ 99 |

Figure 5

(a)

| Mode 1 reward item table | | | | | |
|---|---|---|---|---|---|
| Item name | Usage mode | Number | First level gain probability(%) | Second level gain probability(%) | Third level gain probability(%) |
| Non-providing | NO | 0 | 30 | 60 | 70 |
| Reward item A | Mode 2 | 1 | 12 | 12 | 7 |
| Reward item B | Mode 2 | 1 | 3 | 2 | 2 |
| Reward item C | Mode 2 | 1 | 2 | 1 | 2 |
| Reward item D | Mode 2 | 1 | 1 | 1 | 0 |
| Reward item E | Mode 1,2 | 1 | 13 | 13 | 9 |
| Reward item F | Mode 2 | 1 | 1 | 1 | 1 |
| Reward item G | Mode 1,2 | 1 | 1 | 1 | 1 |
| Reward item H | Mode 2 | 1 | 4 | 2 | 1 |
| Reward item I | Mode 2 | 1 | 6 | 1 | 1 |
| Reward item J | Mode 2 | 1 | 10 | 3 | 3 |
| Reward item K | Mode 2 | 1 | 17 | 3 | 3 |

(b)

| Mode 2 reward item table | | | | | |
|---|---|---|---|---|---|
| Item name | Usage mode | Number | First level gain probability(%) | Second level gain probability(%) | Third level gain probability(%) |
| Non-providing | NO | 0 | 40 | 60 | 70 |
| Reward item G | Mode 1,2 | 1 | 7 | 4 | 5 |
| Reward item H | Mode 1 | 1 | 3 | 2 | 2 |
| Reward item I | Mode 1 | 1 | 2 | 1 | 4 |
| Reward item J | Mode 1 | 1 | 6 | 6 | 2 |
| Reward item K | Mode 1 | 1 | 8 | 8 | 4 |
| Reward item L | Mode 1 | 1 | 1 | 3 | 2 |
| Reward item M | Mode 1 | 1 | 6 | 5 | 4 |
| Reward item I | Mode 2 | 1 | 4 | 6 | 2 |
| Reward item J | Mode 2 | 1 | 6 | 1 | 1 |
| Reward item K | Mode 2 | 1 | 10 | 1 | 3 |
| Reward item L | Mode 2 | 1 | 17 | 3 | 1 |

METHOD FOR PROVIDING REWARD ITEM OF ONLINE GAME AND APPARATUS FOR THE SAME

CROSS REFERENCE TO RELATED APPLICATIONS

This application is a 35 U.S.C. §371 National Phase Entry Application from PCT/KR2012/010093, filed Nov. 27, 2012, and designating the United States, which claims priority under 35 U.S.C. §119 to Korean Patent Application No. 10-2011-0145281 filed Dec. 28, 2011, which are incorporated herein in their entireties.

TECHNICAL FIELD

The present invention relates a technique for increasing interest of users of a game by providing a reward item for a win of a certain mode as an item available in other modes in an online game providing games of various modes to enjoy various modes provided in the game to the users.

BACKGROUND ART

On-line gaming is a field which is becoming more popular in an on-line cultural industry in recent years by the development of networks and computer technology. As online games are developed, the user requires online games in various genres, and currently, online games of many various genres are serviced.

Game modes of the online games are diversified, as are genres of the online games. A mode of an online game may be provided as a single play mode in which the user and the game environment (here, the game environment is one in which a virtual enemy is generally provided in the game service and means one artificial intelligence provided in the game server) perform a match, and a multi-play mode in which a plurality of users perform a mutual match. Also, several mode matches are again provided in the single play mode and the multi-play mode.

Among the matches of the several modes, there is a game achieving a purpose by executing a single match that is performed for a short time, and a game executing a duty that is continuously provided regardless of the match in the game. Also, there is also a game in which a plurality of matches are continuously provided and achieve the purpose by synthesizing a plurality of match results. Among the games achieving the purpose by synthesizing a plurality of match results, there is a tournament type of game or a league type of game. In the tournament type of game as a game performing method of a type that the next match is continuously provided in only a case that each match is won, the character or the team that wins to the end among the characters or the teams joined in the tournament wins overall. Also, in the league type of game, after performing all of a plurality of predetermined matches, the character or the team that obtains a highest winning rate among the joined characters or teams wins overall. In general, in the league game, all the joined characters or teams perform at least one match.

However, as the online game provides the games of the various modes, the cases that the users repeatedly only perform the certain mode suitable to them are increased. For example, a user enjoying the tournament mode has a high tendency to again execute a tournament match after executing one tournament match, and a user enjoying the league mode has a high tendency to again execute a league match.

The mode preference of the user is also generated in a case that the users are only concentrated in the particular mode among a plurality of modes and the users do not activate the rest of the modes. Like this, when the users only enjoy matches of the particular modes, the users do not have interest in the other modes, and if the users perceive tediousness in the match in the preferred mode, the users may lose interest in the corresponding game itself.

The above information disclosed in this Background section is only for enhancement of understanding of the background of the invention and therefore it may contain information that does not form the prior art that is already known in this country to a person of ordinary skill in the art.

DISCLOSURE

Technical Problem

Technical Object

Technical Solution

The present invention maintains an interesting for a game by users by providing a reward item provided when winning in a certain mode as an item to be used in other modes for the users to enjoy various modes provided in the game.

Technical Solution

A method for providing a reward item of an online game reward through an item providing apparatus according to an exemplary embodiment of the present invention includes: generating at least one reward item table corresponding to one mode among a plurality of modes that can be provided in a game and storing at least one reward item available in other modes except for the corresponding mode; setting each win probability of at least one reward item of at least one reward item table; drawing the won item among at least one item according to the win probability in the reward item table corresponding to the executed mode if the character of the user wins the match in the one mode among the plurality of modes; displaying a reward item providing screen providing the won item to the character and including a mode entry button to enter an item display mode as a mode using the won item to the user terminal of the user; and entering the item display mode when receiving a selection input for the mode entry button from the user terminal.

The generating of at least one reward item table may include: generating at least one reward item table in which information for the reward item is not stored; matching at least one generated reward item table to one mode among a plurality of modes; selecting a plurality of reward items to be provided when winning the match for each mode among a plurality of items provided in the game to store at least one reward item table corresponding to the mode; and setting a usage possible mode of the reward item for the reward item table to be available in the other modes except for the corresponding mode for at least one reward item among the plurality of reward items respectively stored to at least one reward item table.

In the storing of at least one reward item table, the at least one reward item table may repeatedly include at least one reward item among a plurality of reward items.

In the setting of the usage possible mode of the reward item, the repeatedly included reward item may be set to be available in the different modes from each other.

In the storing of at least one reward item table, the at least one reward item table may respectively include a non-providing item where the reward item is not provided.

In the setting of the usage possible mode of the reward item, the reward item table storing at least one reward item may be set to be only available in the other modes except for the corresponding mode.

In the setting to be available in the other mode, at least one reward item may be set to be available in only one mode among a plurality of other modes when the other mode except for the corresponding mode is a plurality of modes.

In the setting to be available in the other mode, the reward item table storing at least one reward item may be set to be available in a plurality of modes including the corresponding mode.

The generating of at least one reward item table may further include setting each available due date for a plurality of reward items.

In the setting of the win probability, a plurality of the reward items may be set with different probabilities for at least one reward item table.

A method for providing a reward item of an online game through an item providing apparatus for providing a reward item according to another exemplary embodiment of the present invention includes: selecting at least one reward item corresponding to one mode among a plurality of modes to be provided in a game; setting at least one reward item to be available in other modes except for the corresponding mode; providing at least one reward item corresponding to the mode if the character of the user wins a match in one mode among a plurality of modes; displaying a mode entry button to enter the mode using at least one provided reward item to a user terminal of the user; and entering the mode where the character may have the reward item available if the mode entry button is selected.

The selecting of at least one reward item may include respectively determining a value of at least one reward item, and determining a number of at least one reward item to be provided according to each value of the at least one reward item.

In the setting to be available in the other modes, at least one reward item may be respectively set to be only available to the other modes except for the corresponding mode.

In the setting to be available in the other modes, at least one reward item may be set to be available in only one mode among a plurality of other modes when the other mode except for the corresponding mode is a plurality of modes.

In the setting to be available in the other mode, at least one reward item is set to be available in a plurality of modes including the corresponding mode.

A method for providing a reward item of an online game through an item providing apparatus through an apparatus for providing an reward item according to another exemplary embodiment of the present invention includes: generating at least one reward item table corresponding to one mode among a plurality of modes that can be provided in a game and storing at least one reward item available in the other modes except for the corresponding mode; dividing a level to be obtained by the character into a plurality of level sections; setting different win probabilities according to a plurality of level sections for at least one reward item of at least one reward item table; drawing the won item among at least one item according to the win probability in the reward item table corresponding to the executed mode if the character executes the match in one mode among a plurality of modes and wins the match; displaying a reward item providing screen providing the won item to the character and including a mode entry button to enter an item display mode as a mode that can use the won item on the user terminal of the user; and entering the item display mode when receiving a selection input for the mode entry button from the user terminal.

A reward item providing apparatus of an online game according to another exemplary embodiment of the present invention includes: a character information storing unit storing a plurality of pieces of character information and transmitting win information of at least one character among a plurality of characters; a mode determining unit storing each piece of information of a plurality of mode and transmitting mode information corresponding to the win information of the character; a reward item setting unit generating at least one reward item table corresponding to one mode among a plurality of modes, storing at least one reward item available in other modes except for the corresponding mode to at least one reward item table, and transmitting the corresponding reward item table information according to the mode information; and a probability setting unit setting unit setting a win probability for at least one reward item of at least one reward item table and receiving the reward item table information to provide at least one reward item as a won item according to the win probability.

The reward item setting unit may store a plurality of the reward items to at least one reward item table, and may further stores a non-providing item of which the reward item is not provided.

In the reward item setting unit, the at least one reward item table may include at least one reward item to be repeated among a plurality of reward items, and the repeatedly included reward items are set to be available in the different modes.

The reward item setting unit may set the reward item table respectively storing the at least one reward item to be available in the other mode except for the corresponding mode.

The reward item setting unit may set the reward item table respectively storing at least one reward item to be available in a plurality of modes including the corresponding mode.

The reward item setting unit may set an available due date for a plurality of reward items.

The probability setting unit may display a reward item providing screen transmitting the won item to the character information storing unit and including a mode entry button to enter an item display mode as a mode that can use the won item on the user terminal of the user.

A reward item providing apparatus of an online game according to another exemplary embodiment of the present invention includes: a character information storing unit storing a plurality of pieces of character information including level information and dividing each level of a plurality of characters according to a predetermined level section to determine each level section of the plurality of characters and to transmit win information of at least one character among the plurality of characters; a mode determining unit storing each piece of information for a plurality of modes and transmitting mode information corresponding to winning information of the character; a reward item setting unit generating at least one reward item table corresponding to one mode of a plurality of modes, storing at least one reward item to be available in the other mode except for the corresponding mode to at least one reward item table, and transmitting the corresponding reward item table information according to the mode information; and a probability setting unit respectively setting a win probability for at least one reward item of at least one reward item table according to the predetermined level section and receiving the reward item table information and level section information for the character to provide at least one reward item according to the win probability as a win item.

Favorable Effect

According to the present invention, the reward item provided in the case of winning in the certain mode is provided as the items to be available in the other mode, thereby increasing the interest and the adaptability of the user for the other mode. Accordingly, the users may enjoy the match in the several modes, thereby increasing the interest in the game for the users.

Advantageous Effects

DESCRIPTION OF THE DRAWINGS

FIG. 4 is a division table of a character level section according to one example of the present invention.

FIG. 5 is a reward item table according to one example of the present invention.

MODE FOR INVENTION

Figure 1:
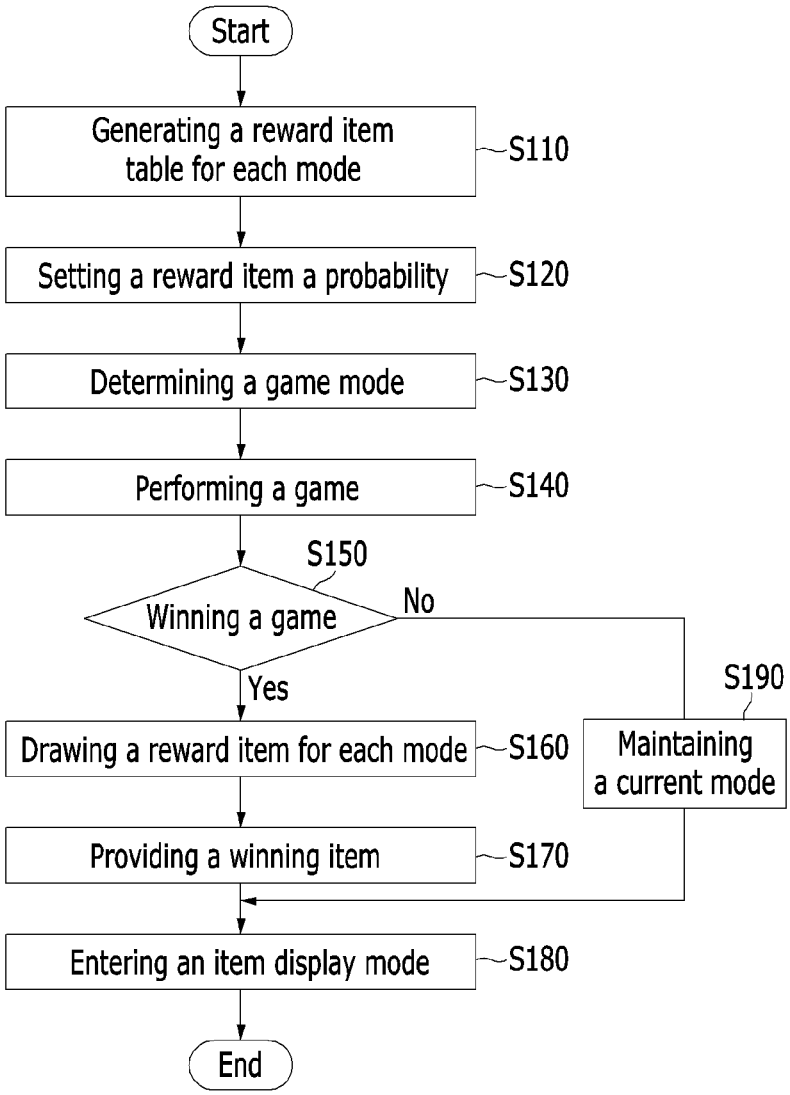
FIG. 1 is a flowchart of a method for providing a reward item of an online game according to an exemplary embodiment of the present invention.

Hereinafter, a method for providing a reward item in an online game and an apparatus thereof according to an exemplary embodiment of the present invention will be described with reference to accompanying drawings.

It is obvious that the following exemplary embodiment is a detailed description which is provided for better understanding of the present invention but does not limit the scope of the present invention. Therefore, an equivalent invention which performs the same function as the present invention may also be covered by the scope of the present invention.

In adding reference numerals to components of each drawing, even though the same components are illustrated in different drawings, it is to be noted that these components are denoted by the same reference numerals if possible. In describing exemplary embodiments of the present invention, well-known functions or constructions will not be described in detail since they may unnecessarily obscure the understanding of the present invention.

In addition, in describing components of the present specification, terms such as first, second, A, B, (a), and (b) may be used. These terms are used only to differentiate the components from other components, but the nature, sequence, order, etc. of the corresponding components are not limited by these terms. When a component is "connected", "coupled", or "linked" to another component, it is to be noted that the component may be directly connected or linked to the other component, but the component may be "connected", "coupled", or "linked" to the other component via another component therebetween.

In an exemplary embodiment of the present invention, "communication", "communication network", and "network" may be used to have the same meaning. The three terminologies indicate a wired or wireless local area and wide area data transmitting/receiving network through which a file is transmitted/received between a user terminal, another user terminal, and a download server.

In the following description, "game server" indicates a server computer that users access to use game contents. In the case of a game which has a small capacity or a small number of users, a plurality of game programs may be operated by one game server. Further, in the case of a game which has a large capacity or a large number of real time accessing members, one or more game servers which operate one game may be provided depending on a function of the game.

In addition, middleware for databases or servers which perform payment processing may be connected to the game server, but the description thereof will be omitted in the present invention.

In the present invention, sports indicate general sports and all kinds of sports which may be played as an on-line game. For example, the sports include soccer, baseball, basketball, tennis, volleyball, track sports, or martial arts.

FIG. 1 is a flowchart of a method for providing a reward item of an online game according to an exemplary embodiment of the present invention.

Referring to FIG. 1, the method for providing the reward item of the online game according to an exemplary embodiment of the present invention firstly generates at least one reward item table for each mode for a plurality of modes to be provided in the game (S110). A reward item providing apparatus according to the present invention generates the reward item table for at least one mode by corresponding with one mode among a plurality of modes, and at least one reward item table respectively includes information of a plurality of reward items to be provided in the corresponding mode. Also, at least one reward item table may store non-providing information that the reward item is not provided as well as a plurality of reward items. At this time, the reward item information included in the reward item table for at least one mode includes an item to be used in the other modes as well as the item to be used in the current mode. That is, when two kinds of modes of the mode 1 and the mode 2 are provided in the game, in the case of winning the match in the mode 1, a reward item that may only be used in the mode 2 is the reward item that may be won in the mode 1. A detailed description for the reward item table will be described later.

If the reward item table for at least one mode is generated, the reward item providing apparatus sets a reward item probability for a plurality of pieces of reward item information included in each reward item table (S120). One piece of reward item information is not included in the reward item table for each mode, but a plurality of pieces of reward item information are included. Accordingly, when a certain character wins in the match of a certain mode, whether any reward item is provided among a plurality of reward items included in the reward item table for each mode must be determined. Therefore, the reward item providing apparatus of the present invention sets the provided reward item to be selected based on the probability, and for this purpose, each probability for a plurality of reward items is respectively set. In this case, each probability of a plurality of reward items may be set to be the same or to be different from each other. For example, every time a match is performed, if the reward item is unconditionally provided, the item is excessively provided such that a value of the reward item is decreased. Therefore, by increasing the probability for the non-providing in the reward item table, a possibility that the reward item is not provided for the willing of the match may be increased. Also, if the item having the highly predetermined value is provided a lot in the game among a plurality of reward items, the entire balance on the game progress may be broken down. Accordingly, a low probability may be set to the item having the high value among the reward items.

If each probability for a plurality of reward items is set, the reward item providing apparatus determines a match mode according to a mode selection signal from the user terminal or the game server (S130). Also, the match is performed according to the determined mode (S140). As described above, the mode may include various modes such as a tournament mode and a season mode in the single play mode and the multi-play mode. The match may be progressed by the user terminal and the game server, and the reward item providing apparatus may receive the item providing determination according to the game progress from the game server and may provide the item. Also, the reward item providing apparatus discriminates whether the character (or the team) managed by the user wins in the progressed match (S150). The match winning discrimination may be obtained from the match result information provided in the game server. As the discrimination result of the match winning, if the match is not won, the current mode is maintained as it is (S190). That is, the same mode as that of the performed match is maintained, and the user may again execute the match in the same mode.

However, as the discrimination result of the match winning, if the match is won, the reward item for the match winning is raffled (S160). Here, the reward item as the lottery object is only performed for the reward items included in the reward item table corresponding to the mode of the executed match. Also, the reward item lottery is performed according to the predetermined probability respectively corresponding to a plurality of reward items included in the reward item table.

If one reward item among a plurality of reward items included in the reward item table according to the predetermined probability is won, the won item is provided to the character winning the match, and the character winning the match receives the won item (S170).

Also, the reward item providing apparatus displays the won item on the user terminal and a won item display screen is provided to the user terminal such that the user may enter the mode displayed at the item.

If the won item is selected, the user must confirm whether any reward item is selected as the won item such that the reward item providing apparatus provides a won item display screen to the user terminal to display the detailed information for the won item. Here, the won item may be an item that may be used in the same mode as the mode of the executed match, but may be an item that may be used in a different mode from that of the executed match, or may be an item that may be used in a plurality of modes.

When the won item is the item that may be used in the different mode, a display such as an item mode entry button to immediately enter the mode using the won item is also provided in the won item display screen. Accordingly, the reward item providing apparatus enters the character of the user into the item display mode according to the selection of the item mode entry button (S180).

In the reward item providing method described in FIG. 1, the reward item providing apparatus respectively provides the reward item table according to a plurality of modes, sets the mode to be respectively available for a plurality of reward items included in the reward item table, and provides the reward item according to the probability.

Accordingly, the reward item for the different mode from that of the executed match may be provided such that the user has interest in the match of the different mode by the provided reward item. Also, since the reward item may be differently provided according to the probability, the user has the expectation for the reward item as well as the fun of the match itself, thereby having a larger interest in the game.

In the above, the reward item is provided through the lottery, however the purpose of the present invention is to enjoy the match of the various modes by the user such that the reward item predetermined for each mode may be unconditionally provided when winning the match. If the reward item for each mode is predetermined, the generation of the reward item table may be omitted.

Also, the reward item is provided through the lottery after progress in every match, however the reward item may be provided through the lottery according to the match progress of predetermined times or other predetermined references. For example, in the tournament match or the league match of the different match progress modes, the reward item may be provided through the lottery when the tournament or the league is won.

Figure 2:
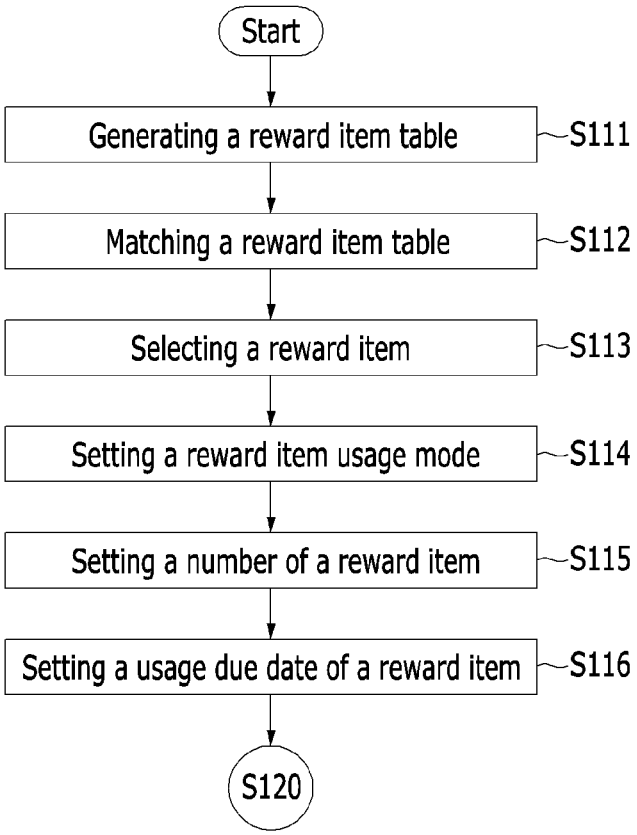
FIG. 2 is a flowchart of generating a reward item table for each mode according to one example of the present invention.

FIG. 2 is a flowchart of generating a reward item table for each mode according to one example of the present invention.

In a step of generating the reward item table for each mode of FIG. 1 described with reference to FIG. 2, at least one reward item table is firstly generated (S111). Here, the at least one generated reward item table is data of an empty table structure in which the information of the reward item is not included. In this case, it is preferable that the number of generated reward item tables is less than the number of modes to be provided in the game.

If at least one reward item table is generated, the reward item table is generated for at least one mode among the modes provided in the game (S112). Matching at least one mode and at least one reward item is the reason that the reward item providing method of the present invention may provide the different reward item for each mode.

Next, a plurality of reward items to be included in the reward item table matched to the mode are selected (S113). A plurality of reward items to be included in the reward item table may repeatedly include the same item. That is, the same item that is referred to as an item A may be repeatedly included two or more times in the reward item table.

If a plurality of reward items are selected to be respectively included in at least one reward item table, a usage mode for a plurality of reward items included in the reward item table is respectively set (S114). In this case, the reward item providing apparatus may set each usage mode for a plurality of reward items as the same mode as the mode of the executed match, or a different mode from the executed match. Also, the mode may be predetermined to be used in the several modes. Further, a plurality of the same reward items are included in the reward item table, and the plurality of the same items may be set to be used in the different modes.

If each usage mode for a plurality of reward items is set, a number of each reward item to be provided when winning is set (S115). A plurality of items provided in the game may have different values according to each function provided by each item. Also, providing only one item having a lowest value among the items having the different values may impart disappointment of the reward item to the user. Therefore, a plurality of the same items may be provided as the reward item according to the value or the kind of the item. Therefore, the reward item providing apparatus sets a providing number for each reward item.

Also, the reward item providing apparatus sets a usage due date to the reward item (S116). Whether the reward item providing apparatus sets the usage due date to the reward item is selective, and the setting of the usage due date for the reward item may be omitted. However, in the present invention, since the reward item is provided to the user to recommend the execution of the match of the other modes, the usage due date may be set for the user to enjoy the match of the other modes as fast as possible. Further, the reward item is raffled every match executed in the certain mode. Also, the number of executed matches may be increased according to the kind of the game. If the reward item is raffled every executed match in this game, the number of items possessed by the character managed by each user is increased, and this requires a storage space of a large capacity to store the character information or the item information according to the item usage of the characters. That is, this causes a high load in the game server or the reward item providing apparatus. Particularly, in the present invention, the reward item to be used in the different modes that the user does not execute is provided. However, when the user enjoys the match only in his preferred mode in spite of the reward item, the reward item that is available in the other modes among the reward items unnecessary occupies the data storage space. Accordingly, it is preferable to set the usage due date for the reward item. In this case, the reward item providing apparatus may set different usage due dates for a plurality of reward items.

If the setting of the usage due date for the reward item is completed, the setting of the reward item probability shown in FIG. 1 is executed (S120).

Figure 3:
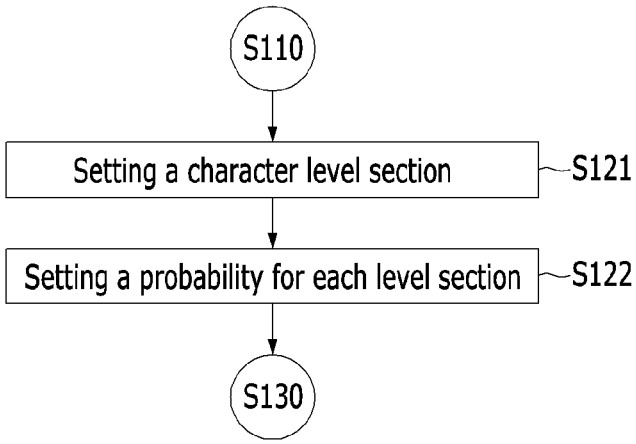
FIG. 3 is a flowchart of setting a probability of a reward item according to one example of the present invention.

FIG. 3 is a flowchart of setting a probability of a reward item according to one example of the present invention.

In FIG. 3, in the setting of the probability of the reward item, a character level section is set (S121). In this case, the reason for setting the character level section is to provide the reward item with the different probabilities from each other according to the level of each character. If the character level section is set, a win probability of the reward item is differently set for each predetermined character level section (S122)

Most of the online games introduce a level system, and the level of each character is determined according to a predetermined reference. In general, a character having a high level has a higher win probability than a character having a low level in a match. This is because a user managing a character at a high level may be basically regarded as a skilled user in the game, and improves with the ability value of the character according to the level. Therefore, the character having the high level has a relatively high win probability of the match compared with the character of the low level. Accordingly, the providing number of the reward items after the character of the high level wins the match is higher compared with the character of the low level. Accordingly, in the present invention, the probability of the reward item to be provided to the character of the high level and the character of the low level is controlled to provide the reward item as uniformly as possible.

FIG. 4 is a division table of a character level section according to one example of the present invention.

For example, in FIG. 4, the character level section is divided into three sections of first to third level sections. The level of the character may be set with various ranges according to the game, and it is assumed that a maximum number of levels is 99 in the present invention. In FIG. 5, the first level section includes levels 1-30, and the second level section includes levels 31-80. Also, the third level section includes levels 81-99. If the character of the 68th level wins the match, the reward item providing apparatus searches the section including the 68th level in the character level section division table of FIG. 4 and selects the searched second level section. Also, lots are drawn for the reward item according to the predetermined probability for the second level section. The number of the level section and the level of the character included in each level section may be variously set.

FIG. 5 is a reward item table according to one example of the present invention.

For example, FIG. 5 shows the reward item table for two modes. Firstly, referring to the reward item table (a) for the mode 1, the reward item table includes six fields of an item name, a usage mode, a number, and first to third level gain probabilities.

The item name is a field in which a name for each reward item is described, and the usage mode is a field in which the mode using each reward item is set. Also, the number is a field in which a number of reward items provided for the win is set. The first to third level gain probabilities are fields in which each win probability of a plurality of reward items is set according to the level of the character that is a reward providing subject, and in FIG. 5, based on the character level section division table shown in FIG. 4, first to third level gain probabilities corresponding to three character level sections are set. However, the number of the level gain probabilities may be controlled corresponding to the number of the character level section divisions.

The number of reward items to be provided in the reward item table (a) of FIG. 5 is 11, from a reward item A to a reward item K, and the available mode to each reward item is described in the usage mode field. In the reward item table (a), it may be set that the reward item A to the reward item K are all used in the mode 2, and particularly, the reward item E and the reward item G are also used together in the mode 1. In this case, it is important that the reward item table (a) is the reward item table for the mode 1. Since the reward item table (a) is the reward item table for the mode 1, the reward item A to the reward item K included in the reward item table (a) are all the items provided as the reward for the executed match in the mode 1. Nevertheless, as shown in FIG. 5, among the 11 reward items, the reward item A to the reward item D, the reward item F, and the reward item H to the reward item K are the reward items to be only available in the mode 2. That is, among the 11 reward items, the items to be available in the mode 1 as the mode currently executing the match is two as the reward item E and the reward item G, and two reward items are also the reward items to be commonly available in the mode 1 and the mode 2. That is, although the character executes the match in the model and gains the reward item, most of the reward items are set to be used in the mode 2. Accordingly, the user may have interest in the match to be executed in the mode 2.

On the other hand, as described above, when the reward item is excessively provided, the balance of the game may not only be broken down, but the value of the itself item may also be deteriorated. For this purpose, a case that the reward item is not provided may be set, and when the reward item is not provided, non-providing is displayed in the item name. The non-providing is to not provide the reward item such that the usage mode is displayed as No. This mode display may be variously according to the setting of the game.

Also, in the reward item table (a), the number field is set to provide one reward item excluding the non-providing. The non-providing does not provide the item such that the number is set as 0.

The fields of the first level gain probability to third level gain probability are set with each win probability of a plurality of reward items, however the first level gain probability to the third level gain probability may be differently set for one same reward item. Since the first level gain probability to the third level gain probability may be differently set for one same reward item, the reward item providing apparatus may control the reward item to be won with the different probability for each level of the character and may set the certain reward item with the win probability of 0 to not draw lots. For example, the reward item D may be set with the third level gain probability of 0 such that the character of the first level section corresponding to the levels 81-99 may be provided with the reward item D. Compared with the reward item D, the third level gain probability is higher than the second level gain probability for the reward item C. That is, it means that the win probability of the reward item may be controlled corresponding to the level of the user.

According to the level of the character, particularly there is no sense of the usage of the partial reward item to the high level user. That is, the level of the character is high such that the influence on the ability value of the character for the function provided by the reward item may be relatively very low compared with the character of the low level. To provide the reward items to the character of the high level is meaningless, and accordingly, the gain probability may be set by 0 to not provide the character of the high level. Compared with this, the reward item of the high value is set with the high gain probability for the user of the high level such that the user of the high level character may have interest in the game of the other modes.

On the other hand, the probability for the non-providing as the probability of the case in which the reward item is not provided, if a sum of the probabilities for the reward items (the reward item A-the reward item K) does not become 100% in the state that the probability for the non-providing is not set, the reward item providing apparatus may be malfunctioning in the reward item lottery. To prevent this problem, the non-providing probability must be set. Also, it is preferable that the probability for the non-providing is set to be high and close to the third level gain probability from the first level gain probability to provide the relatively high reward item to the character of the lower level compared with the character of the high level. Also, the sum of the gain probabilities for each level of a plurality of reward items (the reward item A-the reward item K) including the non-providing must be set to be 100%. As described above, this is to prevent the malfunction of the reward item providing apparatus.

However, if the user wants to set at least one reward item to be won for every lottery, the sum of the gain probabilities for each level of a plurality of remaining reward items (the reward item A-he reward item K) except for the non-providing must be set to be 100%.

On the other hand, referring to the reward item table (b) for the mode 2, the reward item table (b) of the mode 2, like the reward item table (a) for the mode 1, also includes the six fields of the item name, the usage mode, the number, and the first to third level gain probabilities.

The reward items provided in the reward item table (b) are 7 of the reward items G—the reward item M, and the four reward items (the reward item I—the reward item L) among them are repeated twice.

In the reward item table (b), the reward item G is set to be used in both the mode 1 and the mode 2, and the reward item H is set to be only used in the mode 1. However, the reward items (the reward item I—the reward item L) repeated twice are set for the reward item described on an upper end to be only used in the mode 1 and for the reward item described on a lower end to be only used in the mode 2. That is, the repeated reward items are divided to be only used in the different modes. This is because even the same rewards may be divided into the individual reward item if the available modes are separated.

Also, in the mode 2, the first level gain probability for the non-providing is higher than the first level probability for the non-providing in the mode 1. This means that the probability that the character of the first level section is not provided with the reward item is high in the second mode. Also, the difference of the probability according to the mode may be determined by a difficulty of the match for each predetermined mode.

In FIG. 5, for better comprehension and ease of description, the modes provided in the game are two, however a plurality of modes of more than two may be provided in the game.

Figure 6:
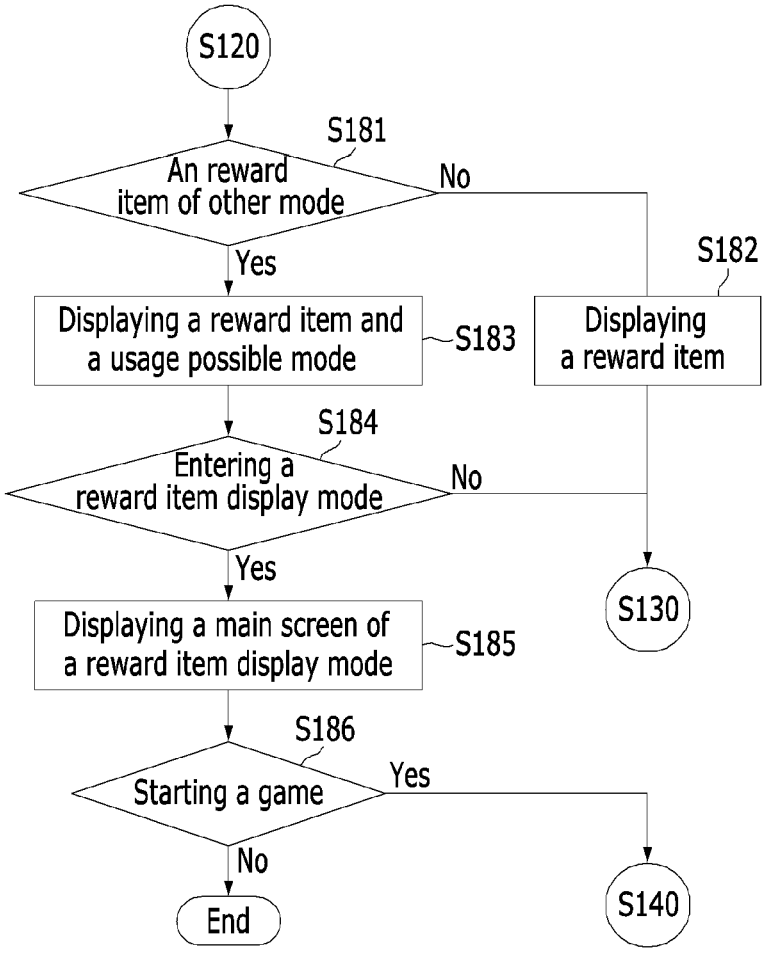
FIG. 6 is a flowchart of an entry to an item display mode according to one example of the present invention.

FIG. 6 is a flowchart of an entry to an item display mode according to one example of the present invention.

In FIG. 6, the entry step into the item display mode determines whether the provided reward item is the reward item that is only available in the other modes that are not the mode in which the game is executed (S181).

When the reward item is not the reward item that is available in the other mode, the available mode is the same as the current mode such that it is not necessary to display the available mode. Accordingly, the detailed description of the reward item is only displayed on the user terminal (S182). Next, the steps from the step of determining the match mode (S130) in FIG. 1 are again performed.

However, if the provided reward item is the available item in the other mode, the available mode as well as the detailed description of the reward item are displayed on the user terminal (S1830. The available mode may be displayed to simply notify the available mode, and a button for directly entering the available mode may be displayed on the user terminal such that the user may easily enter the other mode. Accordingly, the user may directly enter the mode using the reward item.

Accordingly, the reward item providing apparatus determines whether the user enters the mode displayed at the reward item depending on the mode entry button signal from the user terminal (S184). The reward item providing apparatus receives the mode entry button signal from the user terminal and provides a corresponding mode activation signal to the game server in response to the mode entry button signal, thereby displaying a main screen of the reward item display mode on the user terminal (S185). That is, the user may directly enter the reward item available mode displayed at the reward item. However, if the mode entry button signal is not transmitted to the user terminal, the current mode is maintained as it is, and the match mode of FIG. 1 is again executed from the determining step (S130).

If the main screen of the mode displayed at the reward item is displayed, a match start signal is transmitted from the user terminal to determine a match start. If the match starts, the match progress step of FIG. 1 is executed (S140), and if the match is not started, the end is executed.

Figure 7:
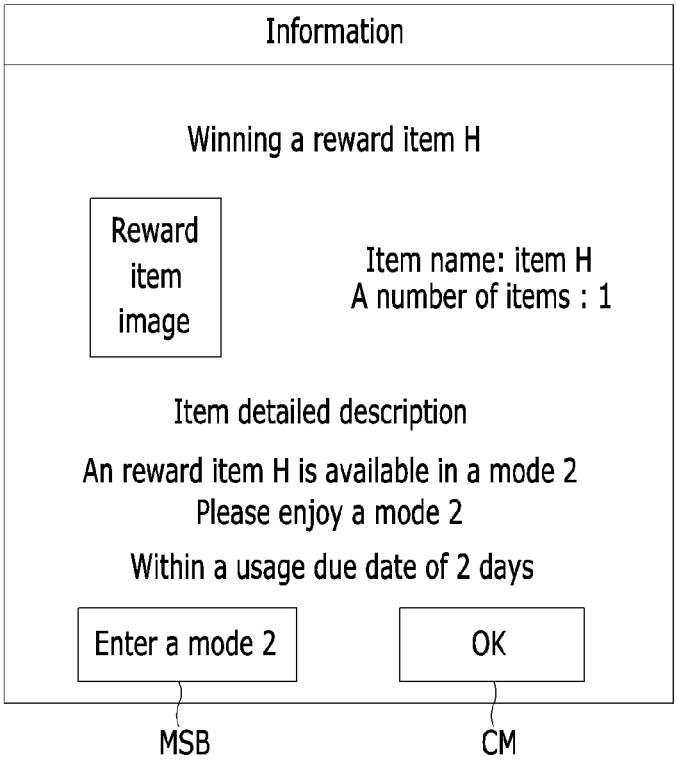
FIG. 7 is a screen providing a reward item according to one example of the present invention.

FIG. 7 is a screen providing a reward item according to one example of the present invention.

The reward item providing screen of FIG. 7 is a screen displayed on the user terminal, and firstly, basic information of the win reward item and the detailed description of the win reward item are displayed along with whether any reward item is won. This is the same as the general item providing screen.

However, the reward item providing screen of FIG. 7 is together displayed for the mode that may use the win reward item. In FIG. 7, the reward item H of the win reward item is displayed with the available reward item in the mode 2. Also, a mode 2 entry button of a mode entry button MSB is provided such that the available reward item H may be directly used in the mode 2. That is, the user selects the mode 2 entry button MSB to directly use the provided win reward item, thereby entering the mode 2. However, to maintain the current mode as it is, an OK button CM may be selected to close the reward item providing screen.

Figure 8:
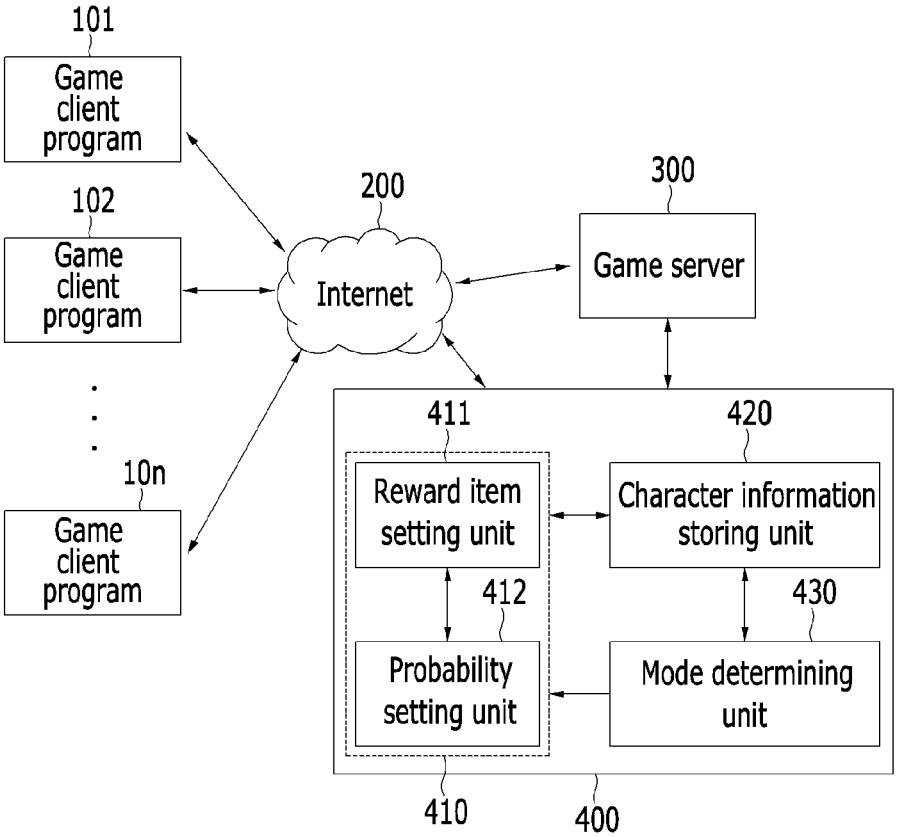
FIG. 8 is a block diagram of a reward item providing apparatus of an online game according to an exemplary embodiment of the present invention.

FIG. 8 is a block diagram of a reward item providing apparatus of an online game according to an exemplary embodiment of the present invention.

Referring to FIG. 8, a system for providing the reward item in the online game according to an exemplary embodiment of the present invention includes a plurality of user terminals 101-10*n*, the Internet 200, a game server 300, and a reward item providing apparatus 400. The plurality of the user terminals 101-10*n* are respectively connected to the game server 300 through the Internet 200 and are installed with a game client to execute the game.

The game server 300 provides a web page to be connected to the user, thereby providing several services such as chat, communities, and shopping malls as well as the Internet game to the plurality of user terminals 101-10*n*. In FIG. 8, the plurality of users are connected to the game server 300 through the computers 101-10*n*, however other terminals connected to the game server 300 through the Internet 200 as well as the computer may be used. For example, a mobile communication terminal or a television which can access the internet may be used.

Also, in the present invention, the game server 300 provides the game entry screen for selecting a game condition by the user.

If the user enters the game through the web page, the game server 300 drives the game client that is previously installed to the user terminals 101-10*n*, and the user terminals 101-10*n* are connected to the game server 300 through the Internet 200 by the driven game client. Here, it is assumed that the game client is previously installed to the user terminals 101-10*n*, however the game server 300 determines whether the game client is installed to the user terminals 101-10*n* and controls to install the game client for the corresponding game at a necessary time.

Also, the game server 300 may include a game database (not shown) storing a logic for each game to control the game. In this case, the game logic represents a specified rule to automatically perform the game according to a predetermined rule, and means one progression process of the game.

The reward item providing apparatus 400 includes an item setting unit 410 generating at least one reward item table, respectively storing the reward item information to at least one reward item table, and setting the win probability of the reward item, a character information storing unit 420 storing a plurality of pieces of character information, and a mode determining unit 430 determining the game mode such as the tournament and the league.

The item setting unit 410 includes a reward item setting unit 411 including at least one reward item table respectively storing a plurality of pieces of reward item information and a probability setting unit 412 setting each win probability for a plurality of reward items.

The reward item providing apparatus 400 firstly generates at least one reward item table from the reward item setting unit 411, and matches at least one generated reward item table to the game mode that may be provided from the game server. That is, at least one reward item table is respectively generated corresponding to one mode of a plurality of modes provided in the game. Also, the reward item respectively included in at least one reward item table is selected and is stored to the corresponding reward item table. In this case, the reward item setting unit 411 may together store the non-providing information that the reward item is not provided to at least one reward item table. Further, the reward item setting unit 411 receives the information of the various modes provided on the game from the mode determining unit to set the mode that is respectively available to a plurality of reward items.

Also, the reward item setting unit 411 sets a number of the items respectively provided at a time for a plurality of reward items.

If at least one reward item table is set in the reward item setting unit 411, the probability setting unit 412 sets the win probability for a plurality of reward items respectively stored to at least one reward item table. The probability setting unit 412 may set the single win probability for a plurality of reward items, however the probability setting unit 412 may respectively set different reward item win probabilities for at least one level section by receiving at least one level section setting when the level of the character provided on the game from the character information storing unit 420 is divided by each section. Also, the probability setting unit sets the probability for the non-proving by deducting the sum of the win probabilities of a plurality of reward items from 100% to prevent the error on the lottery when the sum of the win probabilities of a plurality of reward items is not 100%.

Further, the probability setting unit 412 draws the reward item of the reward item table corresponding to the mode of the won match when the certain character wins the match according to the probability predetermined corresponding to the level of the character.

The character information storing unit 420 stores a plurality of pieces of character information and determines the level of each character and the winning of the match to provide them to the probability setting unit 412, and receives the information for the reward item group won by the probability setting unit 412 from the reward item setting unit 411 to put the reward items into the reward item group to the item own information of the character.

The mode determining unit 430 provides the kind of the mode that may be provided in the game to the reward item setting unit 411 to match at least one reward item table and the mode, and provides each usage mode of a plurality of items of at least one reward item table. Also, the mode determining unit 430 determines the mode of the game that the character wins to provide the reward item table matched with the mode to the probability setting unit 412 through the reward item setting unit 411.

In FIG. 8, the reward item providing apparatus 400 is an apparatus that is separate from the game server 300, however it may be included in the game server 300 and may be realized as a database if necessary. In the above, the character is focused, however the team may be equally applied in a game in which the user manages the team including a plurality of characters.

The method for providing a reward item of an online game and the apparatus thereof in accordance with the exemplary embodiments of the present invention as described above may be executed by the applications basically installed in the terminal (including programs included in a platform, an operating system, or the like which are basically installed in the terminal), and may also be executed by the applications (i.e., programs) which are directly installed in the terminal by the user via an application store server or an application store server such as a web server associated with the applications or the corresponding services. In this respect, the method for providing a reward item of an online game in accordance with the exemplary embodiments of the present invention may be implemented by the applications (i.e., programs) which are basically installed or directly installed by the user in the terminal, and may be recorded in a computer readable recording medium of the terminal and the like.

The programs are recorded in the computer readable recording medium and are executed by the computer, such that the above-mentioned functions may be executed.

As described above, in order for the computer to read the programs recorded in the recording medium and execute the method for providing a reward item of an online game in accordance with the exemplary embodiments of the present invention, the above-mentioned programs may include codes which are coded with computer languages such as C, C++, JAVA, machine language, and the like which may be read by a processor (CPU) of the computer.

The code may include a function code associated with a function of defining the above-mentioned functions, and may also include an execution procedure related control code required for the processor of the computer to execute the above-mentioned functions according to a predetermined procedure.

Further, the code may include a memory reference related code indicating at which location (address number) of the memory inside or outside the computer additional information or media required for the processor of the computer to execute the above-mentioned functions needs to be referenced.

Further, in order for the processor of the computer to execute the above-mentioned functions, when the processor needs to communicate with any other computers or servers, etc. at a remote location, the code may further include a communication related code about how the processor of the computer communicates with any other computers or servers at a remote location or which information or media the processor of the computer transmits and receives at the time of the communication, by using the communication module (for example, a wired and/or wireless communication module) of the computer.

Further, a functional program for implementing the present invention, a code and a code segment associated therewith, and the like may be easily inferred or changed by programmers in the art to which the present invention pertains in consideration of a system environment of the computer which reads the recording medium and executes the program.

Hereinabove, examples of a computer readable recording medium recorded with programs as described above include a ROM, a RAM, a CD-ROM, a magnetic tape, a floppy disk, an optical media storage device, and the like.

Further, a computer readable recording medium recorded with programs as described above may be distributed to a computer system connected through a network and thus store and execute a computer readable code by a distributed manner. In this case, at least one computer among a plurality of distributed computers may execute a part of the above-mentioned functions and transmit the executed results to at least one of the other distributed computers, and the computer receiving the result may also execute a part of the above-mentioned functions and provide the executed results to the other distributed computers.

In particular, a computer readable recording medium recorded with applications, which are programs for executing the method for providing the reward item of the online game in accordance with the exemplary embodiments of the present invention, may be a storage medium (for example, a hard disk and the like) included in an application store server or an application providing server such as a web server associated with applications or corresponding services, and the like, or the application providing server itself.

A computer, which may read a recording medium recorded with applications that are programs for executing the method for providing the reward item of the online game in accordance with the exemplary embodiments of the present invention, may include not only a general PC such as a typical desktop and a laptop, but also a mobile terminal such as a smart phone, a tablet PC, a personal digital assistant (PDA), and a mobile communication terminal, and is to be construed as all the computable devices.

When a computer, which may read a recording medium recorded with applications that are programs for executing the method for providing the reward item of the online game in accordance with the exemplary embodiments of the present invention, is a mobile terminal such as a smart phone, a tablet PC, a personal digital assistant (PDA), and a mobile communication terminal, the applications are downloaded from an application providing server to a general PC and thus may also be installed in the mobile terminal through a synchronization program.

Hereinabove, although it has been mentioned that all components configuring the exemplary embodiment of the present invention described hereinabove are combined with each other as one component or are combined and operated with each other as one component, the present invention is not necessarily limited to the above-mentioned exemplary embodiment. That is, all the components may also be selectively combined and operated with each other as one or more components without departing from the scope of the present invention. In addition, although each of all the components may be implemented by one piece of independent hardware, some or all of the respective components which are selectively combined with each other may be implemented by a computer program having a program module performing some or all of functions combined with each other in one or multiple pieces of hardware. The codes and the code segments configuring the computer program may be easily inferred by a person having ordinary skill in the art to which the present invention pertains. The computer programs are stored in the computer readable media and are read and executed by the computer, and may implement the exemplary embodiment of the present invention. As the storage medium of the computer programs, a magnetic recording medium, an optical recording medium, and the like may be used.

Further, it will be further understood that the terms "comprises" or "have" used in this specification may include the corresponding components unless explicitly described to the contrary, and therefore do not preclude other components and may further include the components. In addition, unless defined otherwise in the detailed description, all the terms including technical and scientific terms have the same meanings as those generally understood by those skilled in the art to which the present invention pertains. Generally used terms such as terms defined in a dictionary should be interpreted as having the same meanings as those within a context of the related art, and should not be interpreted as ideally or excessively formal meanings unless clearly defined in the present specification.

The spirit of the present invention has just been exemplified. It will be appreciated by those skilled in the art that various modifications and alterations can be made without departing from the essential characteristics of the present invention. Accordingly, the exemplary embodiments disclosed in the present invention do not limit but describe the spirit of the present invention, and the scope of the present invention is not limited by the exemplary embodiments. The scope of the present invention should be interpreted by the following claims, and it should be interpreted that all spirits equivalent to the following claims fall within the scope of the present invention.

The invention claimed is:

1. A method for providing a reward item of an online game reward through an item providing apparatus, comprising:

generating at least one reward item table corresponding to one mode among a plurality of modes that can be provided in a game and storing at least one reward item available in other modes except for the corresponding mode;

setting each win probability of at least one reward item of at least one reward item table;

drawing the won item among at least one item according to the win probability in the reward item table corresponding to the executed mode if the character of the user wins the match in the one mode among a plurality of modes;

displaying a reward item providing screen providing the won item to the character and including a mode entry button to enter an item display mode as a mode using the won item on the user terminal of the user; and entering the item display mode when receiving a selection input for the mode entry button from the user terminal.

2. The method of claim 1, wherein the generating of at least one reward item table includes: generating at least one reward item table in which information for the reward item is not stored;

matching at least one generated reward item table to one mode among a plurality of modes;

selecting a plurality of reward items to be provided when winning the match for each mode among a plurality of items provided in the game to store at least one reward item table corresponding to the mode; and setting a usage possible mode of the reward item for the reward item table to be available in the other modes except for the corresponding mode for at least one reward item among the plurality of reward items respectively stored to at least one reward item table.

3. The method of claim 2, wherein, in the storing of at least one reward item table, the at least one reward item table repeatedly includes at least one reward item among a plurality of reward items.

4. The method of claim 3, wherein, in the setting of the usage possible mode of the reward item, the repeatedly included reward item is set to be available in the different modes from each other.

5. The method of claim 2, wherein, in the storing of at least one reward item table, the at least one reward item table respectively includes a non-providing item where the reward item is not provided.

6. The method of claim 2, wherein, in the setting of the usage possible mode of the reward item, the reward item table storing at least one reward item is set to only be available in the other modes except for the corresponding mode.

7. The method of claim 6, wherein, in the setting to be available in the other mode, the at least one reward item is set to be available in only one mode among a plurality of other modes when the other mode except for the corresponding mode is a plurality of modes.

8. The method of claim 2, wherein, in the setting to be available in the other mode, the reward item table storing at least one reward item is set to be available in a plurality of modes including the corresponding mode.

9. The method of claim 2, wherein the generating of at least one reward item table further includes setting each available due date for a plurality of reward items.

10. The method of claim 1, wherein, in the setting of the win probability, a plurality of the reward items are set with different probabilities for at least one reward item table.

11. A non-transitory computer readable record media recorded with a program to realize a method for a providing a reward item of an online game through a reward item providing apparatus, wherein the method includes: generating at least one reward item table corresponding to one mode among a plurality of modes that can be provided in a game and storing at least one reward item available in the other modes except for the corresponding mode;

setting each win probability of at least one reward item of at least one reward item table;

drawing the won item among at least one item according to the win probability in the reward item table corresponding to the executed mode if the character of the user wins the match in the one mode among a plurality of modes;

displaying a reward item providing screen providing the won item to the character and including a mode entry button to enter an item display mode as a mode using the won item to the user terminal of the user; and entering the item display mode when receiving a selection input for the mode entry button from the user terminal.

* * * * *